US007921619B2

(12) United States Patent
Snyder et al.

(10) Patent No.: US 7,921,619 B2
(45) Date of Patent: Apr. 12, 2011

(54) INSULATION BATT HAVING INTEGRAL BAFFLE VENT

(75) Inventors: R. Allan Snyder, Eagleville, PA (US); Richard S. Duncan, Royersford, PA (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 12/562,329

(22) Filed: Sep. 18, 2009

(65) Prior Publication Data

US 2010/0005755 A1 Jan. 14, 2010

Related U.S. Application Data

(60) Division of application No. 11/561,468, filed on Nov. 20, 2006, which is a continuation-in-part of application No. 10/996,225, filed on Nov. 23, 2004, now Pat. No. 7,644,545.

(51) Int. Cl.
*E04B 1/00* (2006.01)

(52) U.S. Cl. ..... 52/742.1; 52/95; 52/199; 52/302.3; 52/407.3

(58) Field of Classification Search ..... 52/95, 198, 52/199, 302.1, 407.3, 309.1, 302.3, 742.1; 454/250, 260, 365, 366
See application file for complete search history.

(56) References Cited

U.S. PATENT DOCUMENTS 2,172,048 A * 9/1939 Johnson ..... 52/407.3
2,330,941 A * 10/1943 Acuff, Jr. ..... 52/407.1
2,477,152 A 7/1949 Stevenson
3,547,839 A 12/1970 Tocker
3,797,180 A 3/1974 Grange
3,862,527 A 1/1975 Peterson
3,863,553 A 2/1975 Koontz
3,884,009 A 5/1975 Frolich et al.
3,972,164 A 8/1976 Grange
4,007,672 A 2/1977 Luckey
4,016,700 A 4/1977 Blomstedt
4,069,628 A 1/1978 Kreimer
4,096,790 A 6/1978 Curran
4,102,092 A 7/1978 Ward
4,114,335 A 9/1978 Carroll
4,125,971 A 11/1978 Ward
4,126,973 A 11/1978 Luckey
(Continued)

FOREIGN PATENT DOCUMENTS

CA 2159869 7/2004
(Continued)

OTHER PUBLICATIONS

Cobra® Ridge Vent Ventilation System, product information, 2 pages, www.pacesupplycorp.com/roofing_vent cobra.htm, accessed Aug. 27, 2004.

(Continued)

*Primary Examiner* — Brian E Glessner
*Assistant Examiner* — Adam Barlow
(74) *Attorney, Agent, or Firm* — Duane Morris LLP

(57) ABSTRACT

A method for insulating and ventilating a space between rafters for supporting a roof includes, an elongated insulation mat having an integral baffle, at least one channel on a roof facing side of the baffle for passage of ventilating air, and at least one vapor permeable membrane covering at least a portion of the insulation mat facing the channel, wherein each vapor permeable membrane transmits water vapor emanating from the insulation mat.

4 Claims, 4 Drawing Sheets

U.S. PATENT DOCUMENTS

| | | | | | |
|---|---|---|---|---|---|
| 4,184,416 | A | * | 1/1980 | Koontz | 454/260 |
| 4,189,878 | A | * | 2/1980 | Fitzgerald | 52/95 |
| 4,194,041 | A | | 3/1980 | Gore et al. | |
| 4,197,683 | A | | 4/1980 | Ward | |
| 4,214,510 | A | | 7/1980 | Ward | |
| 4,237,672 | A | | 12/1980 | Peterson | |
| 4,265,060 | A | | 5/1981 | Woodhams | |
| 4,269,007 | A | * | 5/1981 | Ward | 52/95 |
| 4,280,399 | A | | 7/1981 | Cunning | |
| 4,325,290 | A | | 4/1982 | Wolfert | |
| 4,406,095 | A | | 9/1983 | Slavik | |
| 4,446,661 | A | | 5/1984 | Johnsson et al. | |
| 4,555,982 | A | | 12/1985 | Goubaud | |
| 4,660,463 | A | | 4/1987 | Bottomore et al. | |
| 4,776,262 | A | | 10/1988 | Curran | |
| 4,876,950 | A | | 10/1989 | Rudeen | |
| 4,903,445 | A | | 2/1990 | Mankowski | |
| 4,942,699 | A | | 7/1990 | Spinelli | |
| 4,977,714 | A | | 12/1990 | Gregory, Jr. | |
| 5,007,216 | A | * | 4/1991 | Pearson | 52/94 |
| 5,167,579 | A | | 12/1992 | Rotter | |
| 5,341,612 | A | | 8/1994 | Robbins | |
| 5,433,050 | A | * | 7/1995 | Wilson et al. | 52/302.1 |
| 5,596,847 | A | | 1/1997 | Stephenson | |
| 5,600,928 | A | | 2/1997 | Hess et al. | |
| 5,673,521 | A | | 10/1997 | Coulton et al. | |
| 5,867,956 | A | * | 2/1999 | Gregory et al. | 52/309.13 |
| 5,960,595 | A | | 10/1999 | McCorsley, III et al. | |
| 6,023,915 | A | | 2/2000 | Colombo | |
| 6,346,040 | B1 | | 2/2002 | Best | |
| 6,347,991 | B1 | | 2/2002 | Bogrett et al. | |
| 6,357,185 | B1 | | 3/2002 | Obermeyer et al. | |
| 6,780,099 | B1 | * | 8/2004 | Harper | 454/186 |
| 6,808,772 | B2 | | 10/2004 | Kunzel et al. | |
| 6,881,144 | B2 | | 4/2005 | Hansen et al. | |
| D511,847 | S | | 11/2005 | Ciepliski | |
| D511,848 | S | | 11/2005 | Ciepliski | |
| 7,094,145 | B2 | | 8/2006 | Rye et al. | |
| 2004/0123539 | A1 | * | 7/2004 | Fay et al. | 52/407.3 |
| 2004/0182031 | A1 | * | 9/2004 | Fay et al. | 52/404.1 |
| 2005/0054284 | A1 | | 3/2005 | Ciepliski et al. | |
| 2005/0072072 | A1 | | 4/2005 | Duncan et al. | |
| 2005/0160684 | A1 | * | 7/2005 | Duncan | 52/95 |
| 2005/0215192 | A1 | * | 9/2005 | Rye et al. | 454/260 |
| 2006/0105699 | A1 | | 5/2006 | Kortuem et al. | |
| 2006/0117686 | A1 | | 6/2006 | Snyder et al. | |

FOREIGN PATENT DOCUMENTS

| | | |
|---|---|---|
| CA | 2482054 | 3/2005 |
| CA | 2501920 | 9/2005 |
| CA | 2320590 | 11/2005 |
| GB | 2130269 | 11/1982 |
| GB | 2145756 | 4/1985 |

OTHER PUBLICATIONS

Cobra® (for warmer climates) Ridge Vent II™ Exhaust Vent for Roof Ridge and Cobra® (for harsh winter climates) SnowCountry® Rigid Exhaust Vent for Roof Ridge, product information, one page, undated.

Cobra® Exhaust Vent for Roof Ridge, product information, one page, undated.

Benjamin Obdyke, installation instructions for vent chutes for cathedral ceilings, one page, undated.

Specifications for ROLL VENT® Standard, Benjamin Obdyke, spec. sheet, 2 pages, 2003.

Roll Vent® Attic Ventilation System, product information www.pacesupplycorp.com/roofing_vent_rollvent.htm, 2 pages, accessed Aug. 27, 2004.

Roll Vent® Continuous Ridge Vent, product details, www.benjaminobdyke.com/html/rollvent/rv.html, accessed Aug. 27, 2004.

Owens-Corning/Perma-R, Trade Literature, 1 page, undated.

DiversiFoam, Trade Literature, 1 page, undated.

Apache, Trade Literature, 1 page, undated.

ADO Products, Trade Literature, 1 page, undated.

Meyer, Trade Literature, 1 page, undated.

Practiv/Tenneco, Trade Literature, 1 page, undated.

Shelter Enterprises, Trade Literature, 1 page, undated.

Owens-Corning, RAFT-R-MATE®, Attic Rafter Vents, Trade Literature, 1 page, Sep. 27, 2006.

Johns-Manville, Trade Literature, 1 page, undated.

Moore Products, Trade Literature, 1 page, undated.

Owens-Corning, FormulaR, Trade Literature, Feb. 1999, 2 pages.

Snyder et al., "Smart Vapor Retarders", Building Science, Sep. 2006, 7 pages (http://www.certainteed.com/resources/3028097.pdf).

* cited by examiner

INSULATION BATT HAVING INTEGRAL BAFFLE VENT

CROSS-REFERENCE TO RELATED APPLICATION(S)

This application is a Divisional of U.S. patent application Ser. No. 11/561,468, filed Nov. 20, 2006, which in turn, is a Continuation-In-Part of U.S. patent application Ser. No. 10/996,225 filed Nov. 23, 2004, now U.S. Pat. No. 7,644,545, the entireties of which are hereby incorporated by reference herein.

This application is also related to commonly assigned U.S. patent application Ser. No. 10/666,657 to Richard Duncan and Dustin Ciepliski, entitled "Baffled Attic Vent Including Method of Making and Using Same" filed Sep. 19, 2003, the entirety of which is hereby incorporated by reference herein.

FIELD OF THE INVENTION

The present invention relates to insulation products for vented air spaces, vented insulation product installations and methods of installing insulation products for vented air spaces.

BACKGROUND OF THE INVENTION

In response to a need for energy conservation, there is a need for installing thicker insulation batts to reduce both heat loss in winter and heat gain in summer. Unfortunately, thick cathedral ceiling insulation tends to obstruct, and even close off, the ventilation spaces between roof supporting rafters, which can lead to poor air circulation under the roof.

Providing ventilation spaces between rafters can also help reduce the roof deck temperature to lessen damage to the roof deck and roofing shingles that can result from a build-up of heat to excessive levels in the summer, as well as, the build up of heat during the daylight in winter to melt snow and ice, followed by freezing temperatures that produce ice dams and roof leaks. Roof ventilation is required by most building codes and by shingle manufacturers to validate product warranties.

Quality building construction includes, vented soffits that are substantially unobstructed by insulation, and vented open spaces between rafters that are substantially unobstructed by insulation. Proper ventilation often includes an intake of ambient air through the soffits, and continuing the passage of the ambient air along the open spaces between adjacent rafters, to vent or discharge the build-up of excess humidity, condensation and heat, the presence of which are known to hasten the deterioration of roofing materials and structural components.

Venting moisture adequately from under a roof is particularly a problem for insulated cathedral ceilings, in which the roof supporting rafters double, also serve, as the ceiling joists for supporting the ceiling of an interior space of a building. Batt-type insulation mats having a sufficient R-value thickness are customarily inserted between spaced-apart rafters in cathedral ceilings to insulate the ceilings. Unfortunately, the thick insulation tends to fill the spaces between the rafters, from the ceiling below to the roof sheathing above, and thereby, tends to block ventilating air flow under the roof. Further, although most fibrous insulation mat have a vapor barrier on their interior facing surfaces, moisture from inside a building can pass through open seams and accumulate behind the vapor barrier. Moisture can also bypass the vapor barrier by traveling along skylights, wiring, plumbing and HVAC ducts.

In order to keep cathedral ceiling cavities open, and thereby provide a channel for air flow, baffled vent chutes have been installed above the insulation to promote ventilation. Prior to the present invention, vented cathedral ceilings were often built in a time consuming two-step application process. The installer first placed baffled vent chutes to extend between the rafters, from the eaves to the vented roof ridge, or peak, and stapled the baffled vent chutes to the roof sheathing that was exposed between the roof rafters. Then, batt insulation was installed between the rafters, while the baffled vent chutes held the insulation away from the under surface of the roof. Each baffled vent chute created a maintainable open channel for the passage of ventilating air for venting heat and moisture from the underside or bottom of the roof sheathing.

There is a need, therefore, for an insulation product that reduces installation complexity. Still further, there is a need for an insulation product that promotes ventilation of a space under a roof. Still further, there is a need for an insulation product having an integral baffle and a vapor permeable membrane for venting moisture into a maintainable channel of the baffle for ventilating a space between roof supporting rafters.

SUMMARY OF THE INVENTION

A baffled insulation product for insulating and ventilating a space between rafters for supporting a roof, is fabricated as an elongated insulation mat having an integral baffle, at least one channel on a roof facing side of the baffle for passage of ventilating air, and at least one vapor permeable membrane covering at least a portion of the insulation mat facing the channel, wherein each vapor permeable membrane transmits water vapor emanating from the insulation mat into said channel.

The baffled insulation product of the present invention greatly reduces labor and time associated with installation of a separate baffle followed by installation of insulation material. The baffled insulation product promotes ventilation under a roof by maintaining an open ventilation channel through to the soffit area. A vapor permeable membrane of the insulation product transmits, and allows migration of, water vapor emanating from the insulation mat into the ventilating air stream. The membrane is substantially impervious to water or ambient condensate or other sources of liquid water, and covers at least a portion of the insulation mat to repel liquid water from seeping or percolating therethrough and wetting the insulation mat. Further, the vapor permeable membrane transmits, and permits escape of, excess water vapor due to moisture that builds up in the insulation in the form of increased relative humidity, due to perceptibly slow water leaks from rain or plumbing, and further, due to moisture from other sources inside a building that get behind a vapor retarder facing on the insulation.

According to an embodiment of the invention, the vapor permeability of the vapor permeable membrane increases with increased relative humidity in the insulation. According to another embodiment of the invention, the vapor permeable membrane is substantially impervious to water to prevent the water from seeping into the insulation mat.

Weather conditions involving high ambient wind speeds tend to increase the rate of air exchange between ambient air and quiescent air among the insulation fibers. The heat transfer rate due to the air exchange undesirably increases. The vapor-permeable membrane covers the insulation exposed by the perforated area to reduce the rate of air exchange.

The invention further pertains to a method of insulating and ventilating a space between rafters for supporting a roof, comprising; (a) assembling an insulation product with an insulation mat integral with a baffle having at least one open channel extending the length of the insulation mat, and a vapor permeable membrane covering at least a portion of the insulation mat that faces toward the baffle; and (b) installing the insulation product in a space between adjacent rafters for supporting a roof of a building, with the channel facing toward an under surface of the roof for passage of ventilating air along the space between the adjacent rafters, and with the membrane transmitting water vapor emanating from the insulation mat and into the channel.

According to another embodiment of the invention, a method further comprises, installing the insulation product in a space between the adjacent rafters that are supported above a top plate of an exterior wall of a building, with the channel extending to a space above a ventilated soffit or eave of the roof, such that, the channel maintains a passage for ventilating air to flow from the ventilated soffit or eave, over the top plate, and along the space between the adjacent rafters.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, by way of example, as well as other information, in which.

DETAILED DESCRIPTION

A baffled insulation product for ventilating air under a roof from an open space is described herein in connection with FIGS. 1-8. The insulation product has an insulation mat, such as, a batt, with top and bottom major surfaces, where the top major surface faces the roof when the product is installed in an open space, such as, the space between roof supporting rafters of a cathedral ceiling. The top major surface has a baffle integral or unitary therewith (e.g., formed therein or coupled thereto) comprising at least one airflow channel that provides a continuously open space through which air can easily flow, such as for allowing or directing the flow of ventilating air under a roof supported on the rafters.

Figure 1:
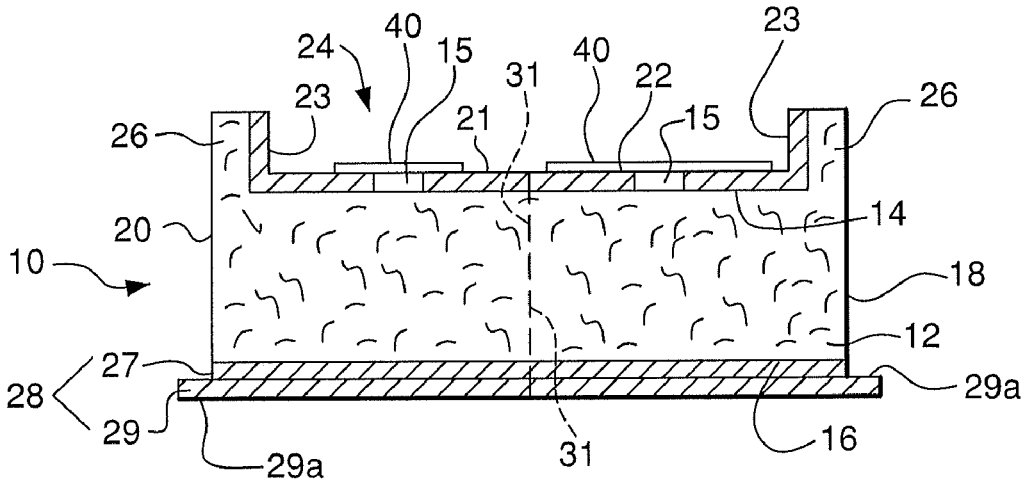
FIG. 1. is an elevation view in section, of a first embodiment of an insulation product integral with a foam or sheet plastic integral baffle.

FIG. 1 discloses a first embodiment of a baffled insulation product 10. The baffled insulation product 10 includes an insulation blanket, mat or batt 12 (hereinafter referred to as mat 12) having top and bottom major surfaces 14, 16, respectively, and a pair of longitudinal side portions 18 and 20. The top major surface 14 has a baffle, or baffle section 22 formed integrally therewith. The baffle 22 forms at least one channel 24 proximate to the top major surface 14 of the insulation mat 12, allowing for the passage of ventilating air when the product 10 is installed in an open space, such as a space between roof supporting rafters. The rafters further support a cathedral ceiling that is insulated by the mat 12.

Insulation materials for forming the mat 12 preferably comprise any of, light weight, flexible and resiliently compressible foams or nonwoven fibrous webs or a combination thereof. Generally, these insulating materials have densities in the range of about 0.5-7 lb/ft$^3$ (8-112 kg/m$^3$), preferably in the range of about 0.5-6 lb/ft$^3$ (8-96 kg/m$^3$), and even more preferably about 1-4 lb/ft$^3$ (16-64 kg/m$^3$). Foam and nonwoven fibrous web materials are usually provided in continuous sheeting that can be cut to preselected lengths, thus forming batts. The thickness of the insulation mat 12 generally corresponds to the desired insulated effectiveness or "R-value" of the insulation. These low density insulation mats typically have a thickness between about 3.5-10 inches and a corresponding R-value proportional to the thickness.

Mat 12 is preferably formed from organic fibers such as polymeric fibers or inorganic fibers such as rotary glass fibers, textile glass fibers, stonewool (also known as rockwool) or a combination thereof. Mineral fibers, such as glass, are preferred. The insulation mat 12 is typically formed from glass fibers, often bound together with a heat cured binder, such as known resinous phenolic materials, like phenolformaldehyde resins or phenol urea formaldehyde (PUFA). Melamine formaldehyde, acrylic, polyester, nylon, urethane and furan binder may also be utilized in some embodiments.

Baffle 22 can take on any number of shapes, as long as at least one channel 24 is formed and made integral with the mat 12. In one embodiment, shown in FIG. 1, the baffle 22 has a generally squat U-shaped cross section, although other shapes are certainly contemplated, such as more rounded shapes, such as arcs, or corrugated shapes that provide more than one channel 24, such as a generally W-shaped cross-section. In one embodiment, the channel has a depth of about 1-2".

Baffle 22 can comprise several different materials, including, by way of example, foamed plastic, unfoamed plastic sheeting, such as PVC (polyvinylchloride) or polypropylene, wood, sheet metal, and cardboard. A foamed plastic, such as polyurethane, polyolefin, or polystyrene foam is preferred. An advantage of using a foamed plastic for baffle 22 is that the foamed plastic can contribute insulative properties in addition to the R-value of the product. Suitable flame resistant materials, such as tris(2,3-dibromopropyl)phosphate, hexabromocyclododecane or equivalent material, can be added to the base material. The baffle section 22 can be manufactured by vacuum forming, injection molding, or a combination of extrusion and a forming step, such as, belt forming, in which the belt has a mold impression therein, which forms the shape of the baffle section 22, or by simply unrolling a sheet material and forming it into the desired shape.

In one embodiment, the baffle 22 comprises a radiant heat reflective top surface facing with an emissivity of less than 0.10, and preferably less than 0.05, such as an aluminized film, which faces the roof (i.e., away from the insulation mat 12) when installed. This aluminized film has an inside surface, facing the insulation of the mat 12, which serves to reduce the radiant heat transfer between the baffle 22 and the roof deck or roof sheathing supported on the rafters, which further support a cathedral ceiling. In one embodiment, the film is aluminized oriented polypropylene (OPP). An example of OPP is model MO115821 available from Dunmore Corp. of Bristol, Pa. The film may also be aluminized polyester (PET-M), such as available from Phoenix Films Inc. of Clearwater, Fla. In another embodiment, the reflective facing comprises a Foil/Scrim/Kraft (FSK) layer, such as model FB30 available from Compac Corporation of Hackettstown, N.J., or an aluminum foil layer.

In the embodiment of FIG. 1, the baffle section 22 is preferably fitted between wing portions 26 of an insulation mat 12, along the entire length of the mat 12 and is thus, generally between about 2-10 feet in length. The baffle 22 can be secured by a friction fit between wings 26, but is more preferably adhered to the top major surface 14 and/or wings 26 via a melt bond, such as a hot melt adhesive, or an adhesive, such as, a urethane moisture cured adhesive or water-based latex adhesive. Alternatively, the baffle section 22 preferably is between about 1-3 feet in width, in certain embodiments, to fit between adjacent rafters installed on centerline spacings of 1-3 feet.

With reference to FIG. 1, the insulation mat 12 has an open channel for receiving baffle 22, such channel being formed in the mat 12 itself. This channel in the mat 12 can be formed by a manufacturing forming section, or the channel can be cut or otherwise formed in an already formed insulation mat 12. The baffle 22 is then fitted between longitudinal wing portions 26 of the mat 12. The baffle 22 is preferably secured to the top major surface 14 and/or wings 26 with an adhesive, such as a hot melt adhesive, urethane moisture cured adhesive or water-based latex adhesive. Alternatively, the baffle 22 could be mechanically fastened, or otherwise secured in association with or proximate to the top major surface 14 of the insulation product 10.

Figure 6:
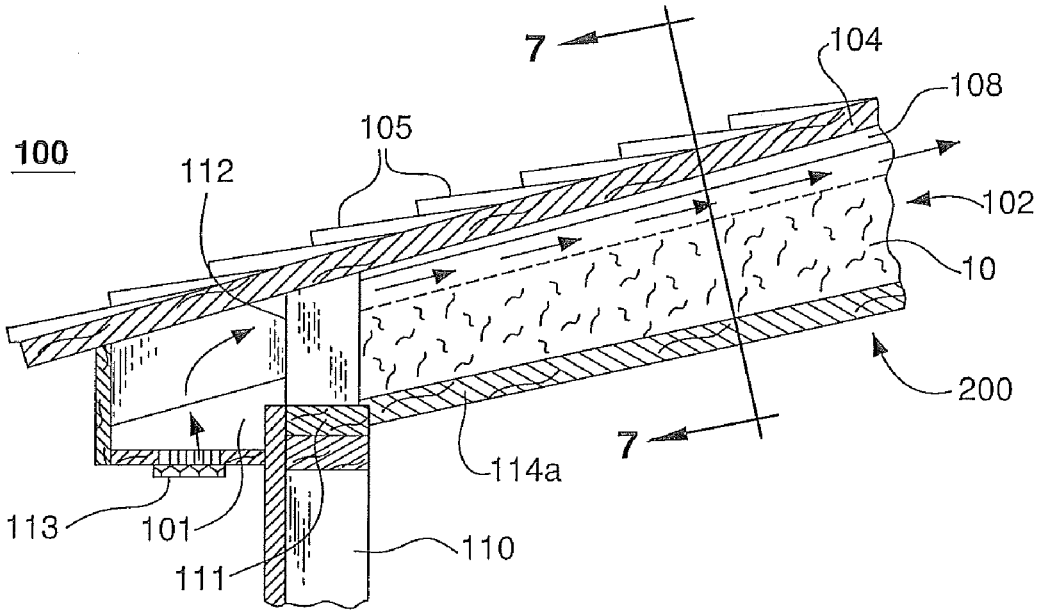
FIG. 6 is a partial side elevation view in section, of the baffled insulation product of FIG. 1 installed under a roof of a building structure and over a cathedral ceiling.

In some embodiments of the insulation mat 12, such as in FIG. 1, a vapor retarder facing 28 is provided on a bottom major surface 16 of the insulation mat 12 to face toward a ceiling to be insulated above by the insulation mat 12. The vapor retarder 28 is comprised of a facing layer 29, which may be a cellulosic paper, typically formed from Kraft paper, coated with a bituminous layer 27, for example, a bituminous adhesive material, such as asphalt, or a polymeric film, such as low density polyethylene (LDPE). The facing layer 29 and bituminous layer 27 together form bitumen-coated Kraft paper 28. The bituminous layer 27 is preferably applied as a coating in a sufficient amount so as to provide an effective barrier or retarder for water vapor, for example, so as to reduce the water vapor permeability of the preferred Kraft paper to no more than about one perm when tested by ASTM E96 Method A test procedure. The insulation mats 12 are installed in spaces between rafters that serve as the ceiling joists for supporting a cathedral ceiling. An installer staples the edge margins 29*a* of the vapor barrier 28 to the rafters to secure the mats 12 in place. Subsequently, a ceiling 114*a*, as disclosed by FIG. 6, is installed, which ceiling 114*a* covers the installed mats 12 to, and which further support and secure the mats 12 in place. The ceiling 114*a* comprises, ceiling panels, such as, nailboard or gypsum board, or paneling that comprises, for example, sheets of paneling, or tongue-and-groove interlocked wood boards, are fastened to the undersides of the rafters, for example, by nails, staples, glue or other fasteners adapted for the intended purpose.

Figure 2:
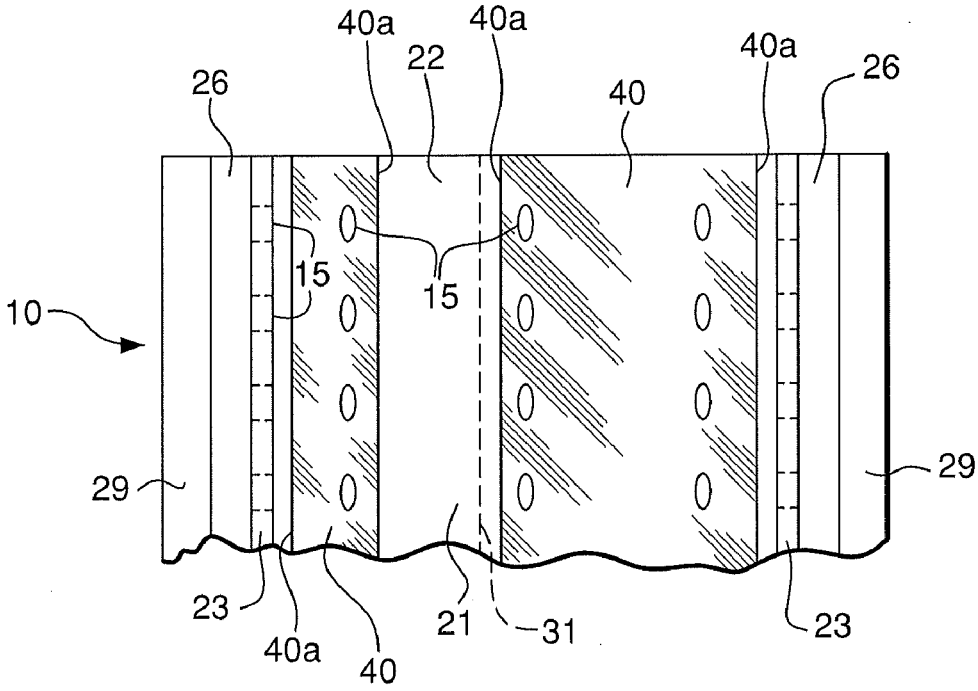
FIG. 2 is a partial, top plan view of the embodiment disclosed by FIG. 1.

FIG. 2 discloses that the baffle 22, such as, a foam or unfoamed plastic baffle 22, includes a perforated area having a plurality of spaced holes 15 extending therethrough for the passage of water vapor due to a build up of moisture, from minor rain leaks and moisture laden air from inside a building, which get behind the vapor retarder 28 and into the insulation mat 12. The moisture is vented from the insulation mat 12, through the holes 15, through the baffle 22 and into the ventilating air stream in each channel 24 of the baffle 27. The holes 15 can be of any size and spacing and can be formed before, during or after affixing the baffle 22 to the insulation mat 12, according to a desired order of manufacturing operations. In one embodiment, the holes 15 are provided through the horizontal bottom wall 21 of the baffle 22. According to another embodiment, additional holes 15 extend through the vertical side walls 23.

In a preferred embodiment disclosed by FIG. 2, the spaced holes 15 of the perforated area, at least in the bottom wall 21, are covered by a vapor-permeable membrane 40 or, alternatively, a smart vapor-permeable membrane 40. also referred to as, a smart vapor retarder. The membrane 40 can comprise, one or more pieces as needed to cover the perforated area of the baffle 22. Multiple pieces are particularly useful to cover different pieces of the baffle 22 that can be separated from one another along transverse and/or longitudinal separators 31, described hereinafter.

The baffled insulation product 10, alternatively, the baffled insulation product 10A, 10B or 10C, described hereinafter, may be separable longitudinally down its center, such as described in, for example, U.S. patent application Ser. No. 10/666,657, US 2005,007,2072A1, incorporated by reference herein. A single separator feature, such as, a longitudinal separator 31 (FIG. 2) may be provided as a portion of the baffle 22, such as, a threaded pull string, score line, weakened area, crease or longitudinal perforation, which is to be manipulated, such that, the baffle 22 can be split into two pieces or more (e.g., in half). Similarly, the underlying insulation mat 12 can be perforated longitudinally or otherwise separable, such as by comprising two or more glued longitudinal sections. The single separator 31 of the baffle 22 is aligned with a corresponding perforation or other separator 31 of the mat 12 so that the insulation product 10 can be split in two pieces, or in half, preferably tearing the mat 12 by hand, to adapt the insulation product 10 for installation in narrow spaces or areas, where the rafters 108 may be spaced closer together. For example, a preferred insulation product 10 fits between rafters on 24" centers, which are most common. In this embodiment, the baffle 22 preferably comprises multiple channels 24, so that splitting the insulation product along its center allows at least one channel 24 to be installed between rafters on 16" or 12" centers, which are less common. The insulation product may also be provided with transverse separators (not shown). This feature enables the installer to save materials by using shorter insulation products.

In FIG. 2, each membrane 40 comprises, for example, a continuous strip that is applied lengthwise of the channel 24, and cut to a desired length. Further, for example, the membrane 40 comprises a continuous strip, with each lengthwise edge margin 40*a* comprising an adhesive coating, which leaves a substantial area between the edge margins 40*a*, uncovered by the adhesive. Accordingly, the membrane area without the adhesive will cover a substantial number of the holes 15. The single membrane 40 or, alternatively, each multiple membrane 40 can be assembled on the surface of the baffle 22 to cover respective holes 15. The vapor permeable membrane 40 covers at least a portion of the insulation mat 12 that faces toward the baffle 22, such that the membrane 40 transmits water vapor that emanates from the insulation mat 12, which water vapor is due to excess moisture that builds up in the insulation mat 12.

A feature of the invention is disclosed by FIG. 2, wherein, the membrane 40, or alternatively, each multiple membrane 40, can be assembled on a roof facing side of the baffle 22. Such a feature is suitable for retrofitting the baffle 22 with the membrane 40. According to an alternative feature of the invention, the membrane 40, or alternatively, each multiple membrane 40, can be assembled on the insulation facing side of the baffle 22, such that the membrane 40 is between the bottom wall 21 of the baffle 22, and the top major surface 14 of the mat 12, whereby each membrane 40 is covered and protected on both sides thereof. According to another alternative feature of the invention, as taught by FIG. 3, the single membrane 40, or each multiple membrane 40, can be assembled directly onto the insulation top major surface 14 of the mat 12 that faces toward the baffle 22, such that when the baffle 22 is assembled over the top major surface 14 and over the corresponding membrane 40, the corresponding membrane 40 will cover respective holes 15 through the baffle 22.

Figure 3:
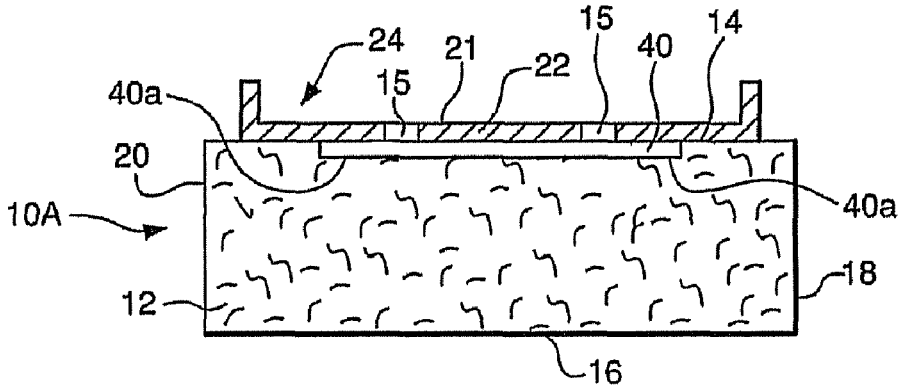
FIG. 3 is an elevation view in section, of a second embodiment of an insulation product integral with a foam or sheet plastic integral baffle.

FIG. 3 discloses an exemplary embodiment in which the vapor permeable membrane 40 is between the top major surface 14 and the baffle 22, and extends over a substantial portion of the major surface 14 of the mat 12. Each lengthwise edge margin 40*a* of the membrane 40 can include an adhesive to adhere the substrate to the surface 14. The area of the membrane 40, between such lengthwise edge margins 40*a*, provides a substantial area of both the membrane 40 and a channel 24 provided by the venting baffle 22, which are uncovered by the adhesive to allow for the movement of air therethrough, and to vent the air into an open space between roof supporting rafters where the insulation product is installed. The baffle 22 can be attached to the top major surface 14 of the insulation mat 12, or to the membrane 40, or to both the membrane 40 and the top major surface 14 of the insulation mat 12.

Further, FIG. 3 discloses an alternative embodiment of the top major surface 14, which is substantially planar (i.e., does not include a channel cut or otherwise formed therein).

In an exemplary embodiment, the vapor-permeable membrane 40 comprises a smart vapor-permeable membrane, i.e., a membrane that changes its moisture vapor permeability with the ambient humidity condition, such as nylon. In one embodiment, the smart vapor-permeable membrane is formed from a material such as the MEMBRAIN™ Smart Vapor Retarder available from CertainTeed Corporation of Valley Forge, Pa. This smart vapor retarder is a polyamide film, specifically about 99-100% by weight nylon 6, blown to approximately 2-mil thickness. The film changes its permeability with the ambient humidity condition. The product's permeance is 1 perm or less when tested in accordance with ASTM E96, dry cup method, and increases to greater than 10 perms using the wet cup method. This process allows the baffled insulation product to increase its drying potential dependent upon the presence of water inside the mat 12, such as, water from inside a building, due to water spills, pipe leaks, appliance leaks, or excessive humidity due to hot water bathing facilities. The vapor permeable membrane 40 reacts to relative humidity by altering pore size, allowing more or less, regulated amounts of water vapor to pass through it. This transformation allows drying to occur through the process of vapor diffusion, thereby improving the speed of drying. The film also allows other trapped moisture to escape from the insulation mat 12, thereby limiting odors in the insulation mat typically associated with mold and bacteria whose growth is encouraged by excess trapped moisture. Further, the film is advantageous to allow for escape of moisture from construction materials that have become damp due to inclement weather and other sources of moisture, before being moved under a roof of a building that serves as the construction site.

Weather conditions involving high ambient wind speeds tend to increase the rate of air exchange between ambient air and quiescent air among the insulation fibers. The heat transfer rate due to the air exchange undesirably increases. The vapor-permeable membrane 40 covers a portion of the insulation mat 12 that would be exposed by the perforated area to reduce the rate of air exchange.

Figure 4:
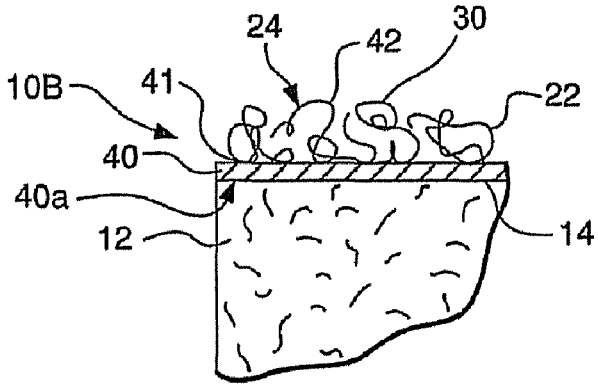
FIG. 4 is a partial view in section, of a third embodiment of an insulation product having an integral baffle comprising a nonwoven ventilation mesh or matting.

In yet another alternative embodiment of a baffled insulation product 10B shown in FIG. 4, the baffled insulation product 10B includes a non-woven matting or ventilation mesh layer 30 of randomly oriented filaments (such as glass or plastic fibers) or wires 42 coupled to a substrate 40, which is, in turn, coupled to the top major surface 14. The matting or ventilating mesh 30 provides the baffle section 22 of porous material for air flow in horizontal and vertical directions. Further, the matting or ventilating mesh 30 provides a channel 24 of porous material to allow for the easy movement of air, specifically the ventilating air in an open space between roof supporting rafters where the insulation product 10B is installed. The mat or ventilating mesh 30 also allows for the passage of water vapor emanating from the insulation mat 12 to enter the ventilating air in the open space between the roof supporting rafters. Such a feature is advantageous to allow for escape of moisture from construction materials that have become damp due to inclement weather and other sources of moisture, before being moved under a roof of a building that serves as the construction site. In one embodiment, the substrate material 40 affixed to the top major surface 14 of the mat 12 is air permeable to permit the free flow of any air when the mat 12 is compressed, such as during packaging. For example, the substrate material 40 may include a layer of open nylon or nylon-polyester matting, in part. Further, the substrate material 40 preferably comprises a smart vapor-permeable membrane or smart vapor retarder membrane, to allow moisture to vent from the mat 12 into the ventilation air stream once installed between rafters.

The filaments or wires 42 compositely provide a resilient characteristic. In one embodiment the filaments or wires 42 comprise nylon filaments, a thermoplastic polyamide resin that may be extruded in situ and heat bonded to the underlying substrate material 40 at randomly spaced points 41, as taught by U.S. Pat. No. 4,942,699 to Spinelli, the entirety of which is hereby incorporated by reference herein. Spinelli '699 teaches that the convoluted matrix is advantageously formed and bonded to the sheet material by extrusion of a melted polymer through articulated spinnerets. One commercial product having a matting or mesh purportedly manufactured according to Spinelli, U.S. Pat. No. 4,9042,699, is a two-layer composite including a nylon-polyester, non-woven, non-wicking fabric, heat bonded to a compression resistant, open nylon matting of three dimensional construction found on the ROLL VENT® Continuous Ridge Vent product available from Benjamin Obdyke of Horsham, Pa. If the non-woven fabric is not vapor-permeable, it is preferably perforated, such as, by having holes 15, followed by covering the perforated area comprised of the holes 15 with the smart vapor permeable membrane 40, in a manner similarly as described herein with reference to the holes 15 disclosed by FIG. 2. Certainly, other substrates 40 may be used, such as perforated polyethylene film or non-woven spun-bonded polypropylene. Further, the ventilation mesh or matting 30 of the preferred embodiment preferably has a density less than that used for exterior ridge vents, as it is not intended to form a barrier to debris and pests as would be the case with a ridge vent, although the ventilation mesh or matting 30 should have sufficient rigidity so as to maintain its porosity for providing a porous ventilation channel 24 once installed between rafters.

Alternatively, the matting or ventilation mesh 30 can be in the form of a unitary sheet of randomly aligned synthetic fibers (e.g., nylon or polyester) that are opened and blended, randomly aligned into a web by airflow, and joined by phenolic or latex biding agents and heat cured to produce and air-permeable varying ventilation mesh. Meshes of this type are taught in U.S. Pat. No. 5,167,579 to Rotter, the entirety of which is hereby incorporated by reference herein. By "unitary", it is meant that the mat material is of unitary sheet construction, rather than sheets laminated or otherwise bonded together. In this embodiment, the matting or ventilation mesh 30 may be coupled to the remainder of the insulation product 10A by a strip or strips of adhesive. Preferably, the matting or ventilation mesh 30 is coupled via strips of adhesive spaced sufficiently to provide a substantial area of the matting or ventilation mesh 30 uncovered by the adhesive, to transmit moisture escaping from the mat 12, through the vapor permeable membrane 40 and into the ventilating air stream.

Figure 5:
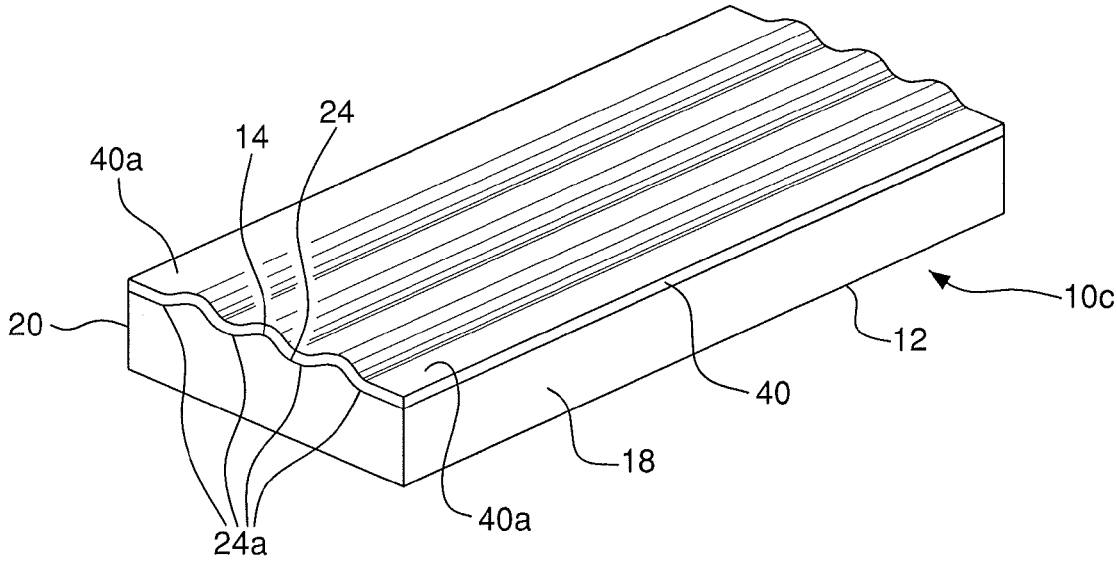
FIG. 5 is a front perspective view of a fourth embodiment of an insulation product having a baffle surface formed therein.

FIG. 5 is a perspective view of an alternative, baffled insulation product 10C where the baffle section 22 is formed directly into the contour of the top major surface 14. In one embodiment, the baffle section 22 has a corrugated shape formed into the top major surface 14 along the entire length of the mat 12. The corrugated shape defines an open channel 24 divided into a plurality of corrugated open channels 24*a* for ventilating air. The channel 24 can be formed directly into the major surface 14 by cutting a portion of the mat 12 from the remainder or main body, or molding a shape into the mat 12 of the insulation product 10 without assembling a separate baffle section 22. The corrugated shape shown in FIG. 4 may be formed by, for example, molding the shape into the mat 12 using a shape former in a binder curing oven of a manufacturing apparatus, or using a roller to form a permanent deformation in the mat 12 after the curing oven. Shapes other than those shown are also appropriate as long as the shape provides through-ventilation.

FIG. 5 further discloses an embodiment of the insulation product 10C having a vapor-permeable membrane 40. The membrane 40 conforms against the corrugated shape of the open channel 24, and substantially covers the entirety of the major surface 14 of the mat 12. The membrane 40 is either sufficiently limp and flexible to conform against the corrugated shape of the open channel 24, or is sufficiently rigid to retain a corrugated shape that fits against the corrugated shape of the open channel 24. Each lengthwise edge margin 40*a* of the membrane 40 comprises adhesive thereon to adhere the membrane 40 to the top major surface 14 of the mat 12, and along the longitudinal side portions 18 and 20 of the mat 12. A substantial area of the membrane 40, and a substantial area of the insulation mat 12, are uncovered by the adhesive to allow for the movement of moisture laden air therethrough, and to vent the air into an open space between roof supporting rafters where the insulation product 10C is installed.

Figure 7:
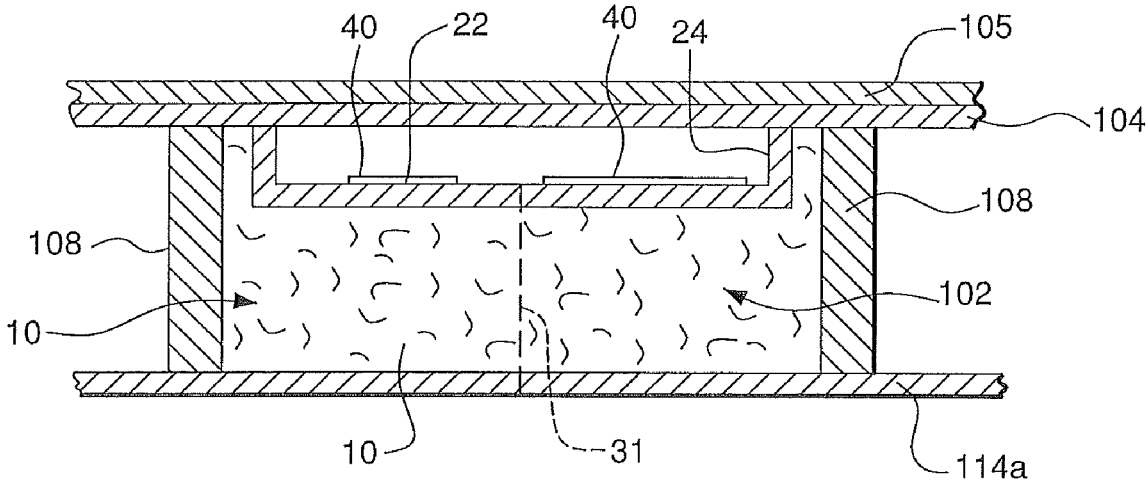
FIG. 7 is a partial sectional view taken along a line 7-7 in FIG. 6.

Baffled insulation products 10, 10A, 10B and 10C are preferably used with sloped or angled ceiling installations, such as with cathedral ceilings, as shown in, for example, a roof assembly 100 disclosed in FIG. 6 and in the section view of FIG. 7. Referring to FIGS. 6 and 7, baffled insulation product 10, by way of example, is shown in relation to a structure or building 200, forming the roof assembly 100. Baffled insulation product 10, alternatively, the baffled insulation product 10A, 10B or 10C, is positioned to provide a vent passage (shown in shadow outline) along the open channel 24 extending to a soffit area or space 101 above a soffit that is ventilated at 113, and along the open space 102 between roof supporting rafters of the building 200. Alternatively, the open channel 24 is defined by the baffle section 22 in either of the embodiments disclosed by FIGS. 1, 3, 4 and 5. Building 200 can be an industrial or residential building, including a home, garage, office and like structure. Building 200 has a conventional top wall plate 111 located on top of an upright exterior wall 110. A generally sloped or angled cathedral ceiling 114*a* extends from top plate 111 to face downward to an interior of the building 200. Roof rafters 108 (shown in the cross section of FIG. 7) extend from, and slope upwardly from, top plate 111, and support a roof comprised of conventional roofing materials, for example, sheathing or boards 104 on which roofing material 105 is installed. Typically, the roofing material 105 includes, an underlayment of roofing felt covered by overlapping layers of either asphalt shingles or roll roofing.

Soffit area or space 101 has a vent 113 for allowing air to move into the soffit area or space 101 beneath the roof overhang. Further, the structure has conventional openings or spaces 112 above the top plate 111 and below the roof, such as, for example, the roof sheathing 104, for passage of ventilating air, indicated by arrows in FIG. 6, entering as ambient air into vents 113 in the vented soffit area or space 101. Further, the spaces 112 are contiguous with the spaces 102 between adjacent roof supporting rafters 108, for passage of the ventilating air upward between the rafters 108, until exiting via a conventional, vented roof ridge or peak (not shown). The baffled insulation product 10, when disposed below the roof sheathing or boards 104, provides an air passage space along the channel 24 of the baffle section 22 that extends to the soffit area or space 101, for the passage of ventilating air to move along the channel 24 and in the space 102 between adjacent rafters 108, from soffit area 101, above the top plate 111, and to the vented roof ridge or peak, not shown. The baffle portion 22 of the baffled insulation product 10, alternatively, the baffled insulation product 10A, 10B or 10C, allows insulation to be placed above ceiling 114*a* and over and adjacent to top wall plate 111, without blocking the passage of the ventilating air. The baffle 22 extends over top plate 111 to prevent the insulation mat 12 from inhibiting the passage of ventilation of air through soffit area 101 and into the space 102 between the rafters 108.

Baffled insulation product 10 is installed between adjacent roof rafters 108. The roof rafters 108 are shown in FIG. 7 and are, for example, 12", 16" or 24" on center. In one embodiment, the baffle 22 is preferably shaped to have an installed convective air flow reading under 5 Pa air pressure differential of between about 35-150 CFM @ 5 Pa.

Further, the invention pertains to a method of insulating and ventilating a space 102 between rafters 108 for supporting a roof, comprising the following steps: (a) providing an insulation product 10, 10A, 10B or 10C having an insulation mat 12 integral with a baffle 22 having at least one open channel 24 extending the length of the insulation mat 12, and a vapor permeable membrane 40 covering at least a portion of the insulation mat 12 that faces toward the baffle 22, and (b) installing the insulation product 10, 10A, 10B or 10C in a corresponding space 102 between adjacent roof supporting rafters 108 of a building 200, with the channel 24 facing toward an under surface of the roof for passage of ventilating air along the space 102 between the adjacent rafters 108, and with the membrane 40 transmitting water vapor emanating from the insulation mat 12 and into the channel 24.

Further, the method comprises, covering the insulation mat 12 with the vapor permeable membrane 40 to repel liquid or water, such as, ambient condensate, from seeping into the insulation mat 12.

Further, the method comprises, installing the insulation product 10, 10A, 10B or 10C in a space 102 between the adjacent rafters 108 that are supported above a top plate 111 of an exterior wall 110 of a building 200, and with the channel 24 extending to a space 112 above a ventilated soffit 113 or eave of the roof and extending along the space 102 between the adjacent rafters 108. Advantageously, when the insulation product 10, 10A, 10B or 10C is installed to cover the top plate 111, the channel 24 maintains a passage for ventilating air to flow from a ventilated soffit 113 or eave, over the top plate 111, and into the space 102 between the adjacent rafters 108.

The baffled insulation product 10, 10A, 10B and 10C of the present invention greatly reduces labor and time associated with providing ventilated attic spaces. With the baffled insulation product, no separate operation is required to install the baffle 22 separate from the chosen insulation material. The baffled insulation product promotes ventilation under a roof and other open spaces by maintaining an open ventilation channel through to the soffit area and/or to the roof ridge area. The insulation product also allows for improved migration of water vapor emanating from the insulation mat 12 into the ventilating air stream.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention.

What is claimed is:

1. A method of insulating and ventilating a space between rafters for supporting a roof, comprising:

installing an insulation product with an insulation mat integral with a baffle having substantially vertical walls and a substantially horizontal bottom wall and having holes through the bottom wall of the baffle and having at least one open channel extending the length of the insulation mat, and a water vapor permeable membrane on a roof facing side or on an insulation facing side of the bottom wall and covering the holes through the bottom wall and covering at least a portion of the insulation mat that faces toward the baffle, by installing the insulation product in a space between adjacent rafters for supporting a roof of a building, with the channel facing toward an under surface of the roof for passage of ventilating air along the space between the adjacent rafters, and with the permeable membrane allowing for the transmission of water vapor emanating from the insulation mat and into the channel, wherein a vapor permeability of the vapor permeable membrane increases with increased relative humidity in the insulation; and ventilating moisture through the holes through the bottom wall of the baffle and into the ventilating air, while covering the holes through the bottom wall with the vapor permeable membrane and repelling liquid water from wetting the insulation mat, and while transmitting water vapor that emanates from the insulation mat.

2. The method of claim 1, further comprising:

installing the insulation product in a space between the adjacent rafters that are supported above a top plate of an exterior wall of a building, with the channel extending to a space above a ventilated soffit or eave of the roof and along the space between the adjacent rafters, such that, the channel maintains a passage for ventilating air to flow from the ventilated soffit or eave, over the top plate, and along the space between the adjacent rafters.

3. The method of claim 1, further comprising:

assembling the baffle in between wings of the insulation material.

4. The method of claim 1, further comprising:

installing an interior room ceiling on the rafters, wherein the ceiling comprises, gypsum board or nailboard or paneling.

* * * * *